US007312465B2

(12) United States Patent
Schaber

(10) Patent No.: US 7,312,465 B2
(45) Date of Patent: Dec. 25, 2007

(54) RADIATION SHIELDING SYRINGE CONTAINER WITH ANTI-STICK BARRIER

(75) Inventor: Brian M Schaber, West Allis, WI (US)

(73) Assignee: Vulcan Global Manufacturing Solutions, Inc., Milwaukee, WI (US)

( * ) Notice: Subject to any disclaimer, the term of this patent is extended or adjusted under 35 U.S.C. 154(b) by 259 days.

(21) Appl. No.: 11/254,618

(22) Filed: Oct. 20, 2005

(65) Prior Publication Data

US 2006/0086909 A1 Apr. 27, 2006

Related U.S. Application Data

(60) Provisional application No. 60/621,850, filed on Oct. 25, 2004.

(51) Int. Cl.
*G21F 5/018* (2006.01)

(52) U.S. Cl. ..... 250/506.1; 250/515.1

(58) Field of Classification Search ..... None
See application file for complete search history.

(56) References Cited

U.S. PATENT DOCUMENTS 3,973,554 A 8/1976 Tipton
4,056,096 A 11/1977 Collica et al.
4,185,619 A 1/1980 Reiss
4,846,235 A * 7/1989 Handke ..... 141/311 R
6,162,198 A 12/2000 Coffey et al.
6,586,758 B2 * 7/2003 Martin ..... 250/506.1
6,797,973 B2 * 9/2004 Zens ..... 250/515.1
7,165,672 B2 * 1/2007 Fago et al. ..... 250/506.1

* cited by examiner

*Primary Examiner*—Jack I. Berman
(74) *Attorney, Agent, or Firm*—Michael Best & Friedrich LLP

(57) ABSTRACT

A radiation-shielding container for storing a syringe includes a base assembly, a sleeve and a cap assembly securable to the base assembly. The base assembly includes a body portion defining a chamber portion for receiving the syringe and including a base portion coupled to the body portion. The base portion includes a radiation shield and a shell positioned proximate an outer surface of the radiation shield. The sleeve configured for receiving a portion of the syringe is housed within the chamber portion and releasably secured to the base assembly. The cap assembly defines a second chamber portion for receiving the syringe and includes a radiation shield and a shell positioned proximate an outer surface of the radiation shield.

28 Claims, 12 Drawing Sheets

RADIATION SHIELDING SYRINGE CONTAINER WITH ANTI-STICK BARRIER

CROSS-REFERENCE TO RELATED APPLICATION

This application claims priority from U.S. Provisional Patent Application No. 60/621,850, entitled "Radiation Shielding Syringe Container with Anti-Stick Barrier", filed Oct. 25, 2004 by Brian Schaber.

BACKGROUND

The invention relates to a radiation-shielding container for a syringe, and more particularly, a container including an anti-stick barrier to prevent a user from being stuck by the syringe needle.

Certain types of drugs, known generally as radiopharmaceuticals, are preferably transported in containers that incorporate radiation-shielding features and materials. These containers often include shielding portions of lead or tungsten that prevent radiation emitted from the radiopharmaceutical from reaching the surroundings of the container. Some radiopharmaceuticals are produced in liquid form and are therefore suitable for injection into a patient using a syringe.

Unlike some injection-based medications, which are generally supplied in a vial from which a dose is subsequently drawn, radiopharmaceuticals are often supplied pre-measured in individual syringes. By supplying a pre-measured amount of radiopharmaceutical in an individual syringe, the amount of handling of the radiopharmaceutical associated with administering a dose of the radiopharmaceutical is minimized. Also, the amount of time during which the radiopharmaceutical is unshielded during dose administration can be reduced.

When administering any medication from a syringe, great care must be taken to avoid accidental needle sticks. In this regard, syringes are often provided with special caps that cover the syringe needles until such time as the dose is ready to be administered.

SUMMARY

In one embodiment, the invention provides a radiation-shielding container for storing a syringe. The radiation-shielding container includes a base assembly, a sleeve, and a cap assembly securable to the base assembly. The base assembly includes a body portion defining a chamber portion for receiving the syringe and including a base portion coupled to the body portion. The base portion including a radiation shield and a shell positioned proximate an outer surface of the radiation shield. The sleeve is configured for receiving a portion of the syringe, and the sleeve is housed within the chamber portion and releasably securable to the base assembly. The cap assembly defines a second chamber portion for receiving the syringe and includes a radiation shield and a shell positioned proximate an outer surface of the radiation shield.

In another embodiment, the invention provides a radiation-shielding container including a syringe, a base assembly, a sleeve, and a cap assembly securable to the base assembly. The syringe includes a body, a plunger depending from one end of the body and axially movable relative to the body, and a needle extending from an opposite end of the body. The base assembly houses a portion of the syringe, and includes a body portion and a base portion. The body portion of the base assembly defines a chamber portion for receiving at least the body and the needle of the syringe. The base portion is coupled to the body portion and defines a cavity for receiving a portion of the body portion. The base portion includes a radiation shield and a shell positioned proximate an outer surface of the radiation shield. The sleeve is configured for receiving at least the body of the syringe, and the sleeve is housed within the chamber portion and is securable to the base assembly. The cap assembly houses a portion of the syringe and defines a second chamber portion for receiving at least the plunger of the syringe. The cap assembly includes a radiation shield and a shell positioned proximate an outer surface of the radiation shield.

In yet another embodiment, the invention provides a radiation-shielding container for storing a syringe includes a base assembly, a body assembly, a sleeve, and a cap assembly securable tot eh base assembly. The base assembly defines a cavity and includes a radiation shield and a shell positioned proximate an outer surface of the radiation shield. The body assembly includes a first section defining a first chamber portion and a second section defining a second chamber portion for receiving a portion of the syringe. The first section of the body assembly is coupled to the base assembly and the second section is receiving within the cavity of the base assembly. The sleeve is generally cylindrical and is adapted and configured for receiving a portion of the syringe. The sleeve is housed within the first chamber portion of the body assembly and is releasably securable to the first section. The sleeve includes a radiation shield. The cap assembly defines a chamber portion for receiving a portion of the syringe, and includes a radiation shield and a shell positioned proximate an outside surface of the radiation shield.

Other aspects and advantages of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

DETAILED DESCRIPTION

Figure 1:
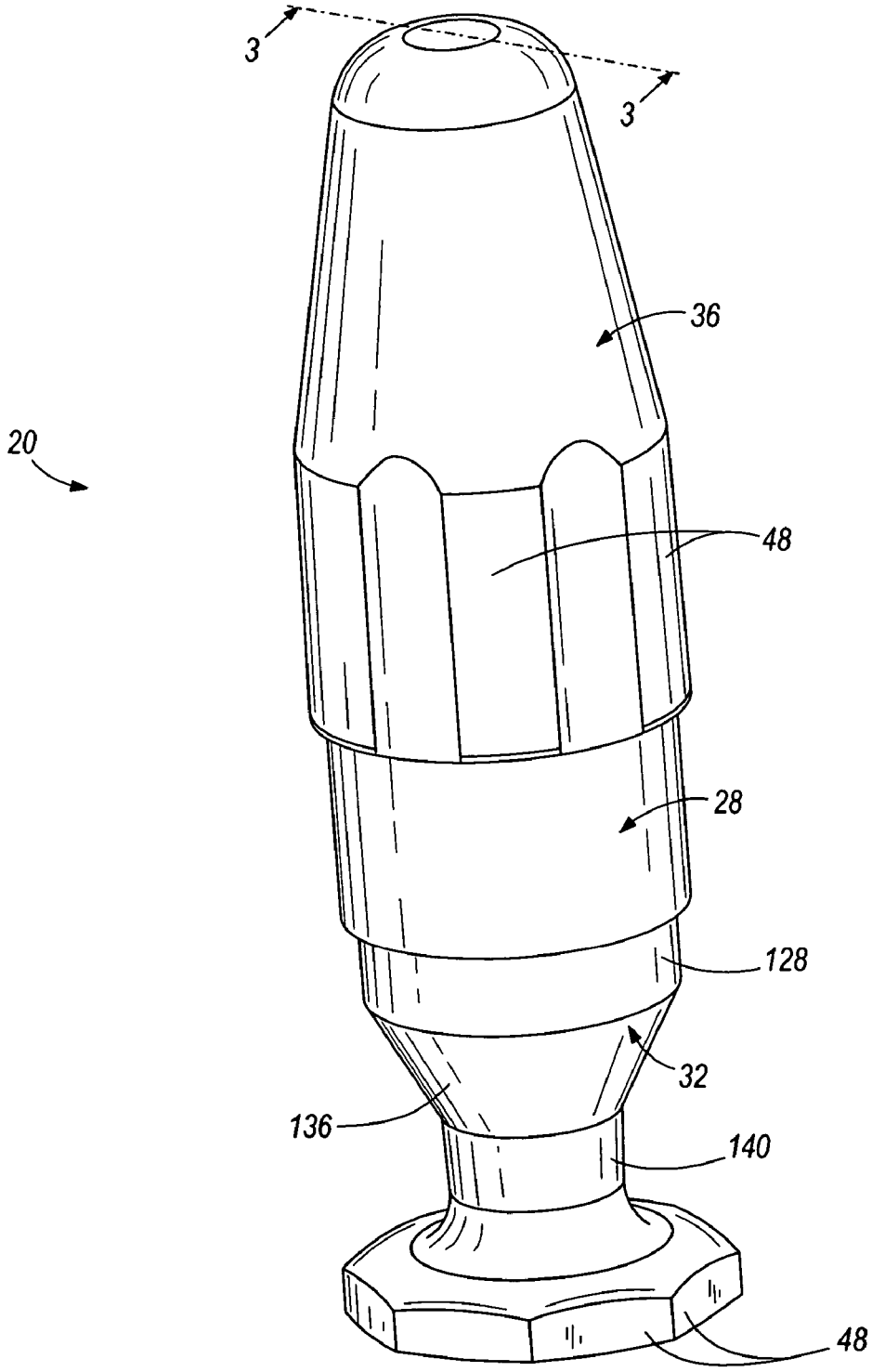
FIG. 1 is a perspective view of a radiation-shielding syringe container embodying some aspects of the present invention.

FIG. 1 illustrates a single unit dose radiation-shielding container 20, or radiopharmaceutical pig, for storing and transporting a syringe 24. The container 20 includes a body 28, a base 32 coupled to the body 28, a cap 36 that is securable to the body 28, and a syringe sleeve 40 (FIG. 2) that is securable within the body 28. When secured, the cap 36 and the body 28 define a chamber 44 (FIG. 3) for storing the syringe 24. In the illustrated embodiment, the base 32 and the cap 36 include a plurality of flats 48, whereby the flats 48 facilitate opening and closing of the container 20.

Figure 2:
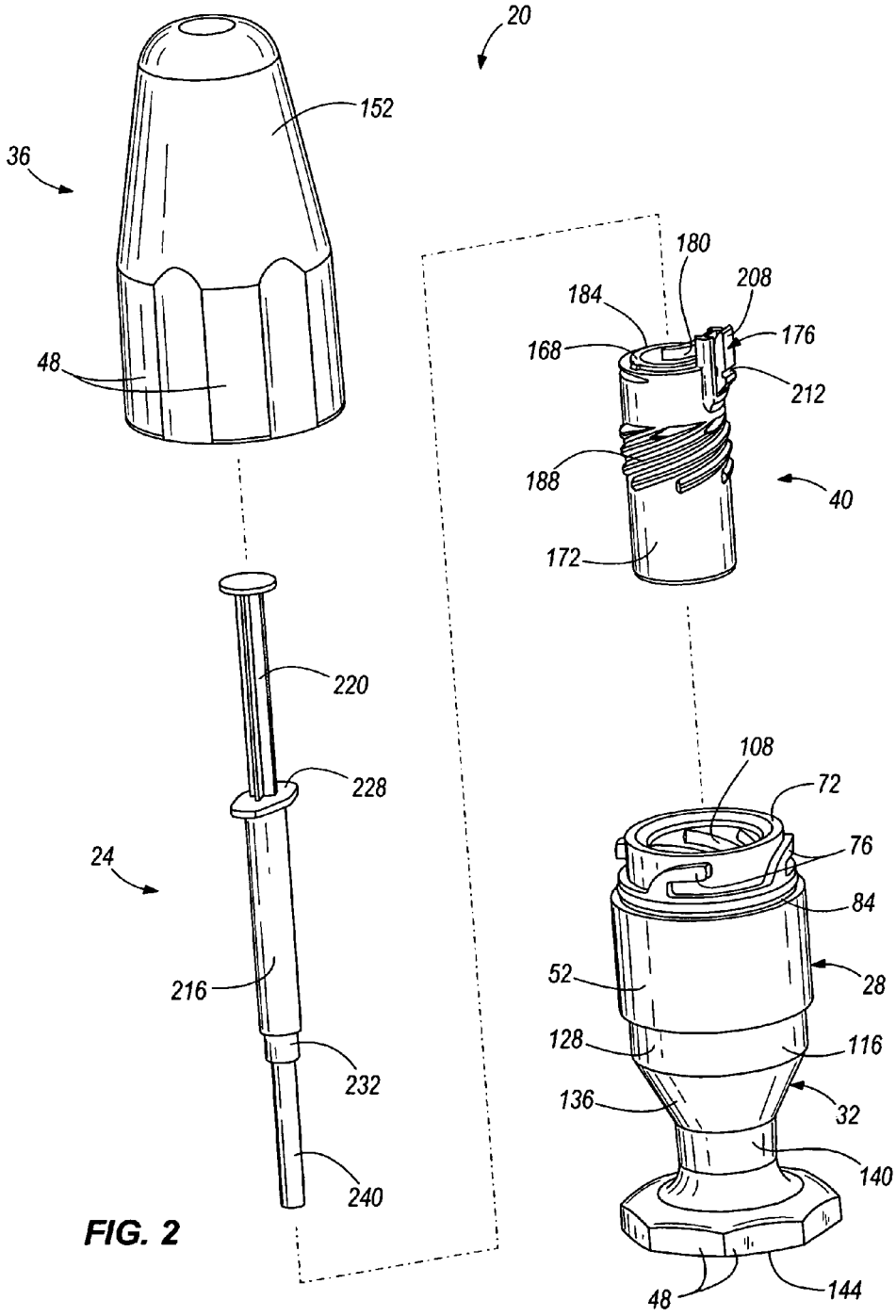
FIG. 2 is an exploded perspective view of the radiation-shielding syringe container illustrated in FIG. 1.
Figure 3:
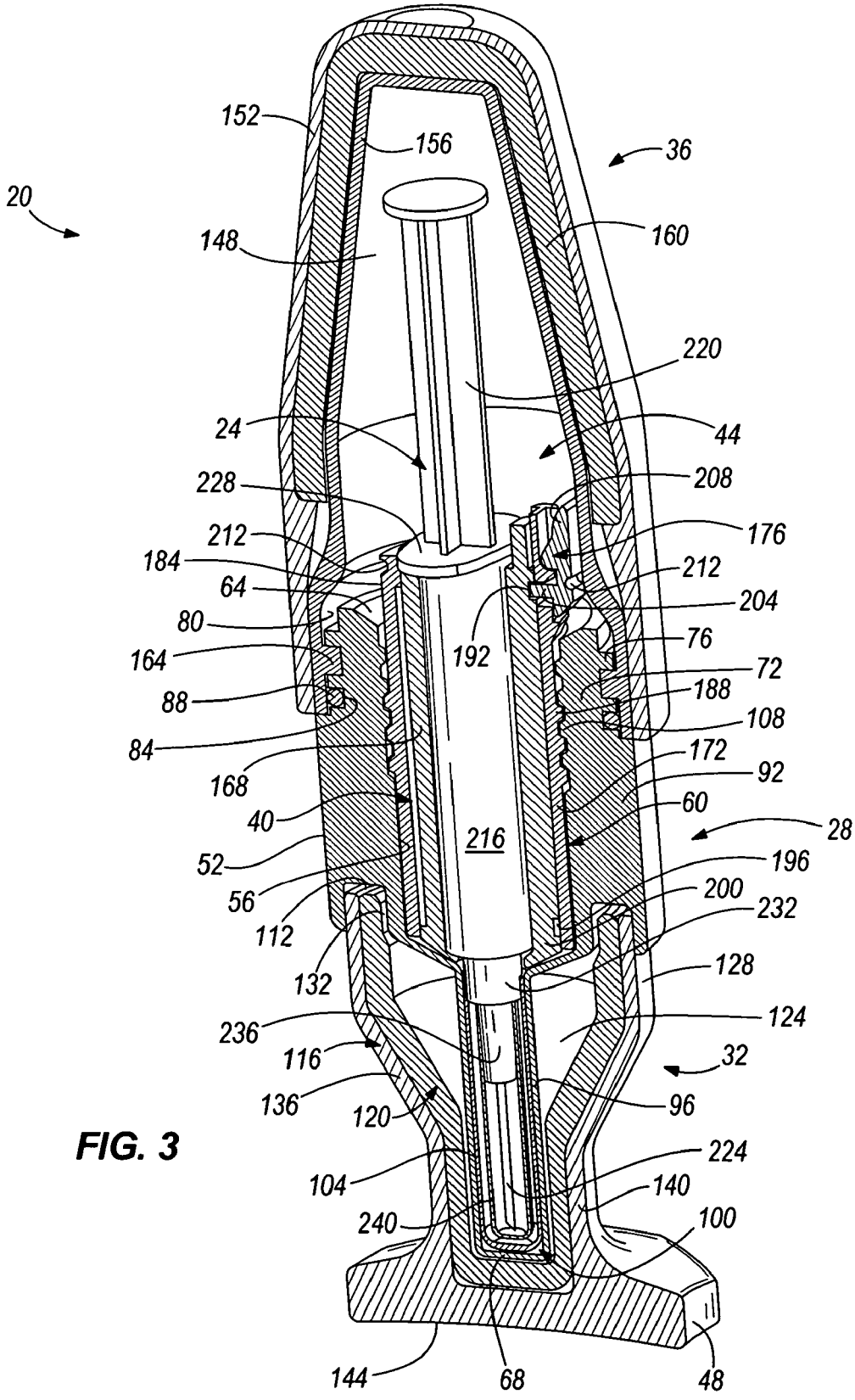
FIG. 3 is a section view taken along line 3-3 of FIG. 1 and showing the container and syringe in a transportation configuration.
Figure 4:
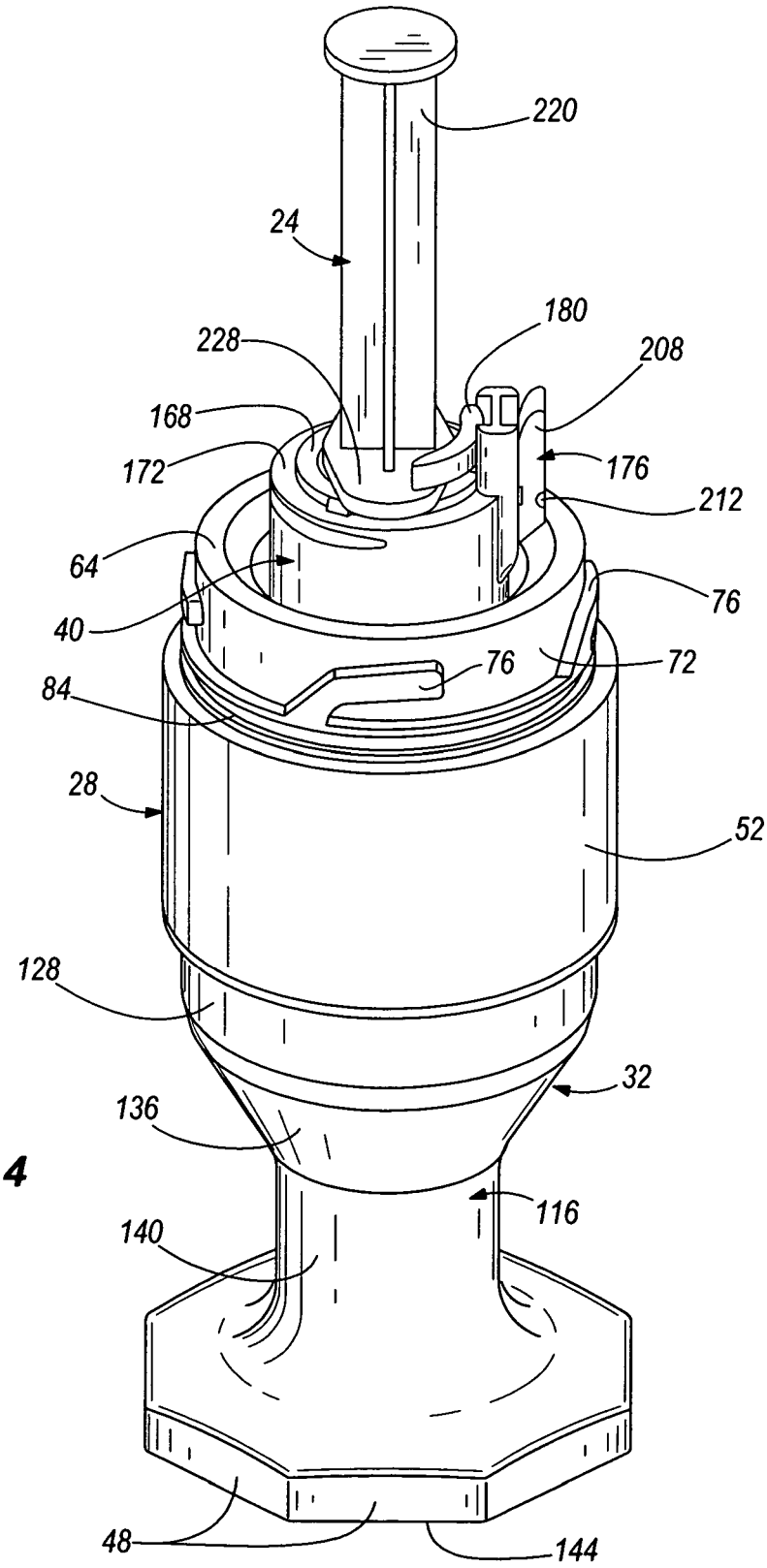
FIG. 4 is a perspective view of the radiation-shielding syringe container illustrated in FIG. 1 with a cap portion removed.

Referring also to FIGS. 2-4, the body 28 is generally cylindrical and, in the illustrated embodiment, is formed of a suitable polymer, such as nylon 66. The body 28 includes an outer surface 52 and an inner surface 56 that defines a chamber portion 60 having an open end 64 and a closed end 68. The outer surface 52, adjacent the open end 64, defines an annular protrusion 72 having a cap-securing structure in the form of radially outwardly extending ribs 76. The annular protrusion 72 extends into an open end 80 of the cap 36. In the illustrated embodiment, four ribs 76 are provided and are substantially equally spaced about the circumference of the open end 64. Axially inwardly spaced from the ribs 76, the outer surface 52 defines a circumferential groove 84 that is adapted to receive a resilient O-ring 88. The O-ring 88 engages the cap 36 to substantially seal the chamber 44 when the cap 36 is secured to the body 28.

The body 28 includes a first section 92 and a second section 96, which has a reduced diameter relative to the first section 92 and defines the closed end 68 of the chamber portion 60. Thereby, the chamber portion 60 includes a reduced diameter portion 100. The reduced diameter portion 100 receives a bio-liner 104, as discussed further below, formed of plastic, poly-plastic, polypropylene, ABS, or the like. The inner surface 56 at the first section 92 of the body 28 defines an internally threaded portion 108 for securing the syringe sleeve 40 within the chamber portion 60. The first section 92 of the body 28 also defines an external annular channel 112 that opens toward the closed end 68 of the chamber portion 60. The annular channel 112 is adapted to receive the base 32, as discussed further below.

The base 32 includes an outer portion 116, or shell, and an inner, radiation shield 120. The shell 116 is formed of a suitable polymer that may be similar to the polymer utilized for the body, and the radiation shield 120 is formed of a radiation-shielding material such as lead, tungsten, or the like. The radiation shield 120 is received by the shell 116 and is coupled thereto by a suitable adhesive. It should be readily apparent to those of skill in the art that the shield 120 and shell 116 may be coupled together by any number of methods, including fasteners, clips, interlocking portions, overmolding the shield 120, or the like.

The base 32 defines a cavity 124 for receiving the body 28 of the container 20. The base 32 includes an upper cylindrical portion 128 that defines an opening 132 and is received by the annular channel 112 of the body 28. In one embodiment, the base 32 is coupled to the body 28 by an adhesive that bonds the upper cylindrical portion 128 within the annular channel 112, although other known coupling methods may be used. The base 32 includes an intermediate frusto-conical portion 136 that extends from the upper cylindrical portion 128 to a reduced-diameter lower portion 140, which receives the reduced diameter, second section 96 of the body 28. A bottom surface 144 of the base 32 supports the container 20. It should be readily apparent to those of skill in the art that the base 32 may have another shape, such as generally cylindrical.

The cap 36 is generally cup-shaped to define a chamber portion 148 and includes an outer protective portion 152, or shell, an inner protective portion 156, and an intermediate radiation shield 160 positioned between the shell 152 and the inner portion 156. In the illustrated embodiment, the shell 152, the shield 160, and the inner portion 156 are bonded to one another with an appropriate adhesive. However, in a further embodiment the three pieces may be coupled together by any number of methods, including fasteners, clips, interlocking portions, or the like, or the shell 152 and the inner portion 156 may be a single piece formed by overmolding the shield 160, injection molding, or the like. The shell 152 is formed of a suitable polymer, which may be similar to the polymer utilized for the body 28 and the shell 116 of the base 32, and the radiation shield 160 is formed of a radiation-shielding material such as lead, tungsten, or the like.

The inner portion 156 of the cap 36 defines a body-securing structure in the form of radially inwardly extending projections 164. The projections 164 cooperate with the ribs 76 to provide a releasable attachment between the cap 36 and the body 28. In the illustrated embodiment, to couple the cap 36 to the body 28, the annular protrusion 72 of the body 28 is inserted into the open end 80 of the cap 32, i.e., the cap chamber portion 148, and the cap 36, or the body 28, is rotated approximately one-quarter turn to engage the ribs 76 with the projections 164. The open end 80 of the cap 36 also engages the O-ring 88 when the cap 36 is coupled to the body 28 to provide a fluid tight seal for the chamber 44. It should be readily apparent to those of skill in the art that other coupling methods may be used for securing the cap 36 to the body 28, such as a threaded engagement.

The syringe sleeve 40 is generally cylindrical and includes an inner radiation shield 168, an outer sleeve 172, and a latching member 176 pivotally coupled to the outer sleeve 172. The outer sleeve 172 is axially slidable relative to the radiation shield 168 of the syringe sleeve 40. The radiation shield 168 is formed of radiation-shielding material, such as lead, tungsten or the like, and includes a generally retaining member 180 at an upper end 184 thereof. In the illustrated embodiment, the outer sleeve 172 is formed of a suitable polymer, which may be similar to the polymer utilized for the body 28 and the shells 116, 152 of the base 32 and the cap 36.

The outer sleeve 172 includes an externally threaded portion 188, which in the illustrated embodiment is positioned proximate a mid-point of the outer sleeve 172. The externally threaded portion 188 is configured for engagement with the internally threaded portion 108 of the body 28. The threaded engagement allows for support of the syringe sleeve 40 within the body 28, while allowing relative axial positioning of the syringe sleeve 40 with respect to body 28.

Figure 5:
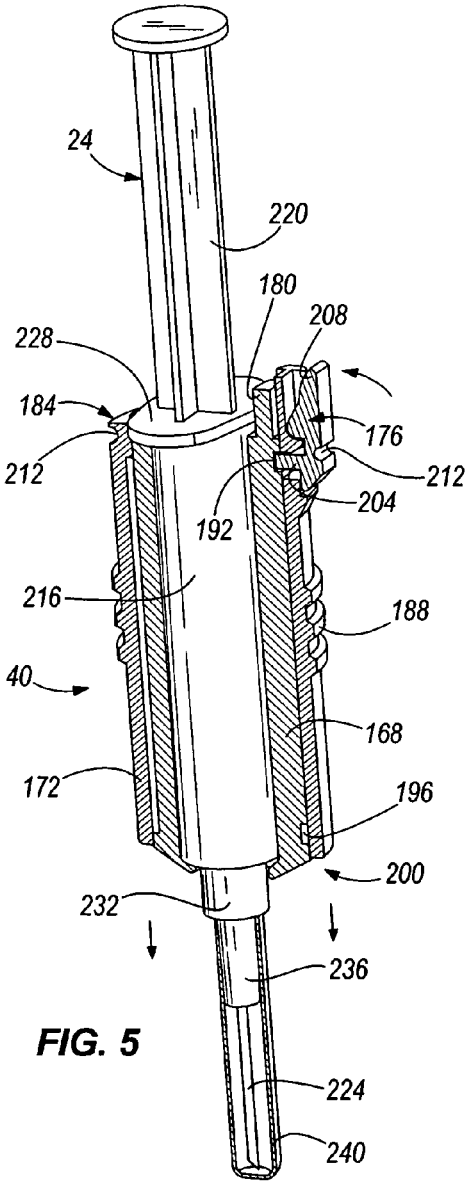
FIG. 5 is a sectional view of the syringe and a syringe sleeve prior to dispensing a dose.
Figure 6:
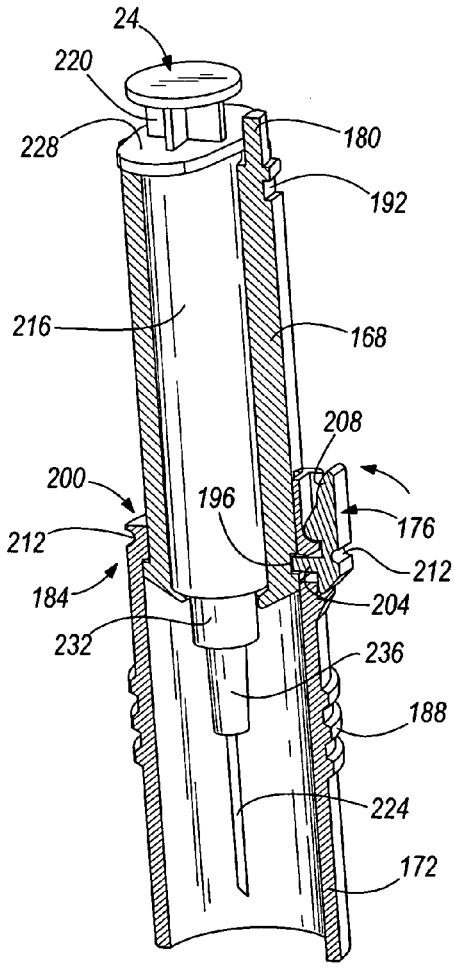
FIG. 6 is a sectional view similar to FIG. 5 showing an anti-stick barrier of the syringe sleeve in an extended position.

Referring to FIGS. 5 and 6, the outer sleeve 172 is axially movable with respect to the radiation shield of the syringe sleeve 40 between a retracted position (FIG. 5) and an extended position (FIG. 6). The radiation shield 168 defines a first recess 192 near the upper end 184 and a second recess 196 near a lower end 200. The latching member 176 includes a tab portion 204 and an upwardly projecting actuating portion 208. When the outer sleeve 172 is in the retracted position, the tab portion 204 of the latching member 176 engages and is received by the first recess 192, thereby securing the outer sleeve 172 in the retracted position. To move the outer sleeve 172 to the extended position, the actuating portion 208 is depressed, thereby pivoting the latching member 176 to disengage the tab portion 204 from the first recess 192. The sleeve 172 is then moved axially until the tab portion 204 engages and is received by the second recess 196. The latching member 176 is biased such that the tab portion 204 is urged into positive engagement with the recesses 192, 196. An external annular groove 212 is formed in an upper end of the outer sleeve 172 and the latching member 176 for receiving an O-ring (not shown), which keeps the tab portion 204 of the latching member 176 biased into positive engagement with the recesses 192, 196.

The container 20 is configured to hold the syringe 24. The syringe 24 includes a generally cylindrical body 216, a plunger 220 that depends from one end of the body 216, and a needle 224 that extends from an opposite end of the body 216. The plunger 220 is axially movable with respect to the body 216 to fill or dispense liquid form within the body 216, as is known in the art. The body 216 defines a radially extending flange 228 at the plunger end that facilitates movement of the plunger 220 with respect to the body 216. The syringe 24 also includes a reduced diameter portion 232 and a frusto-concial portion 236 extending between the body 216 and the needle 224, such that the needle 224 is at least partially supported by the frusto-conical portion 236. The syringe 24 includes a removable protective cap 240 that fits snugly around, for example by a pressure fit, the frusto-conical portion 232 and covers the needle 224, thereby preventing accidental needle sticks.

In use, the syringe 24 is filled with a pre-measured dose of a radiopharmaceutical at a pharmacy or a lab and the filled syringe 24 is transported to a patient in the radiation-shielding container 20. After the dose is administered, the voided syringe 24 is returned to the container 20. The container 20 and the syringe 24 are returned to a pharmacy or lab, whereby the voided syringe 24 is removed from the container 20 and disposed of.

A technician fills the syringe body 216 with radiopharmaceutical by operating the plunger 220 in a known manner. The protective cap 240 is placed over the needle 224 and the filled syringe 24 is then inserted into the syringe sleeve 40. The retaining member 180 is configured to receive and positively capture the syringe flange 228 upon engagement and relative rotation of the syringe body 216 with respect to the syringe sleeve 40. If necessary, the outer sleeve 172 of the syringe sleeve 40 is moved to the retracted position.

With the cap 36 removed to expose the chamber 44, the syringe sleeve 40 with attached syringe 24 is inserted into the body 28 such that the needle 224 and the protective cap 240 are received by the reduced diameter portion 100 of the body chamber 60. Upon engagement of the internally and externally threaded portions 108 and 188, the syringe sleeve 40 is rotated with respect to the body 28 until the relative axial position of the syringe sleeve 40 with respect to the body 28 is similar to that illustrated in FIG. 3. In the illustrated embodiment, the preferred axial position is reached when the protective cap 240 abuts the bio-liner 104, which in turn abuts the closed end 68 of the body 28.

With the syringe sleeve 40 properly positioned within the chamber portion 60, the cap 36 is coupled to the body 28. In the illustrated embodiment, the syringe sleeve 40 and the syringe 24 are positioned such that the radiation shields 120, 168 of the base 32 and the syringe sleeve 40 axially overlap the body 216 and the needle 224 of the syringe 24. In one embodiment, the syringe sleeve 40 is positioned such that the radiation shield 168 axially overlaps with the radiation shield 120 of the base 32 and the radiation shield 160 of the cap 36. Alignment of the radiation shields in this manner, and with the body and the needle of the syringe, prevents a line-of-sight path from the chamber 44 to the surroundings for radiation emissions from the radiopharmaceutical in the syringe. The reduced diameter portion 232 of the syringe 24 is axially spaced from the bio-liner 104 when the container 20 and the syringe 24 are in the transport configuration, as seen in FIG. 3.

With the cap 36 secured and the syringe 24 held firmly in place by the syringe sleeve 40, the container 20 is transported from the pharmacy or the lab to a hospital, clinic, or other facility, where the radiopharmaceutical is to be administered to a patient. To administer the radiopharmaceutical, the entire container 20 is brought to the patient. The cap 36 is removed from the body 28 and then the syringe sleeve 40, while securely holding the syringe 24, is removed by rotating the syringe sleeve 40 to disengage the threaded portions 108, 188. Because the syringe sleeve 40 is configured to remain in surrounding relation to the body 216 of the syringe 24, some level of radiation shielding can be maintained during administration of the dose. The protective cap 240 is removed from the syringe 24, thereby exposing the needle 224, and the radiopharmaceutical is then injected into the patient by depressing the plunger 220.

After the radiopharmaceutical has been injected into the patient, the outer sleeve 172 of the syringe sleeve 40 is moved to the extended position by operating the latching member 176 in the manner discussed above with respect to FIGS. 5 and 6. When the outer sleeve 172 is in the extended position, it extends beyond the needle 224, thereby creating an anti-stick barrier. The syringe 24 and the syringe sleeve 40 are then returned to the container 20. When the syringe sleeve 40 is inserted into the body chamber portion 60, the latching member 176, and in particular the actuating portion 208, is manually actuated to allow the outer sleeve 172 to move toward the retracted position as the radiation shield 168 passes through the open end 64 of the body 28. In a further embodiment, the latching member 176 is configured to allow automatic actuation of the latching member 176 as the syringe sleeve 40 is inserted into the body 28.

Figure 7:
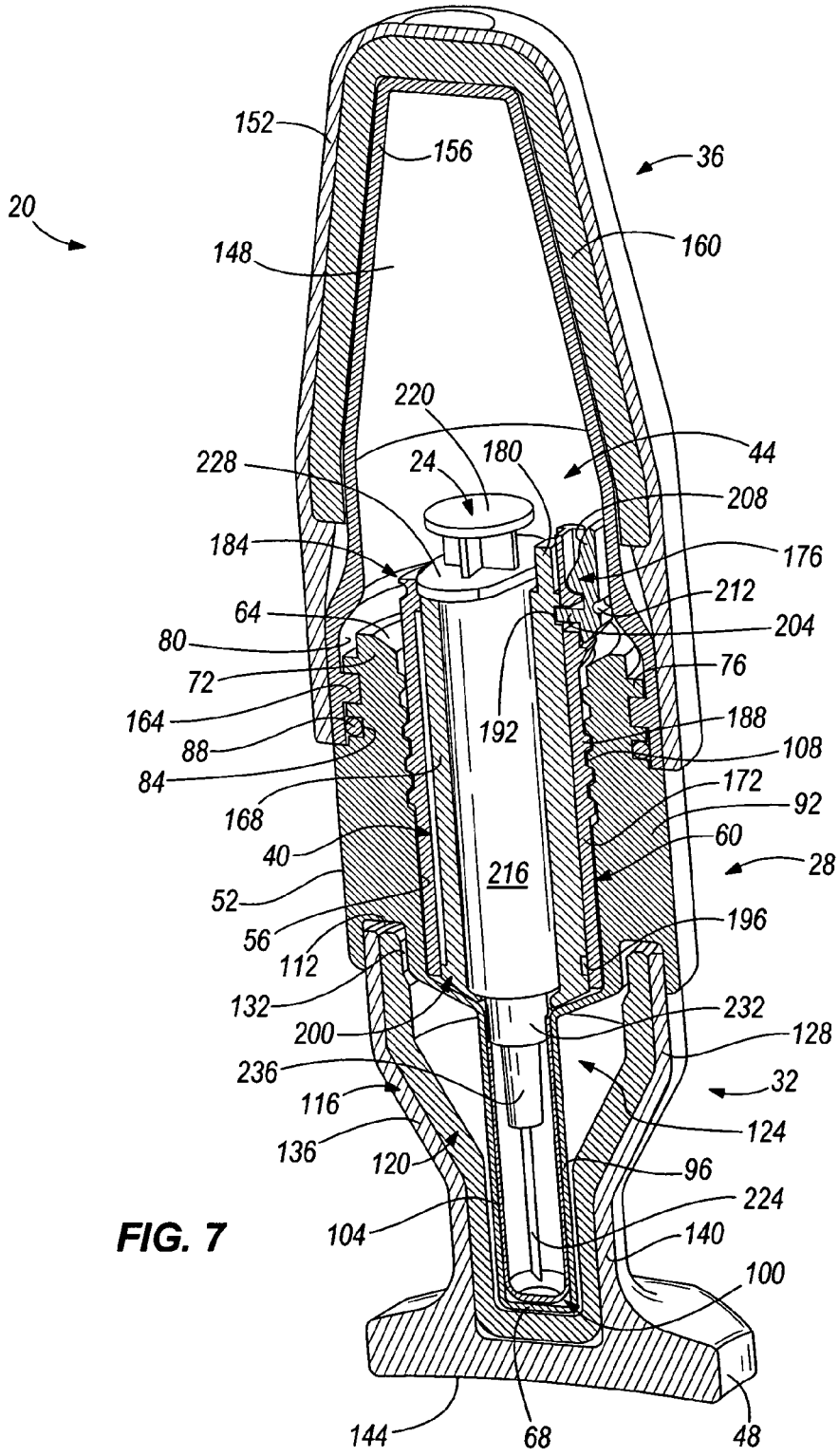
FIG. 7 is a section view similar to FIG. 3 showing the container and syringe configuration after the contents of the syringe have been dispensed and the syringe has been returned to the container.
Figure 8:
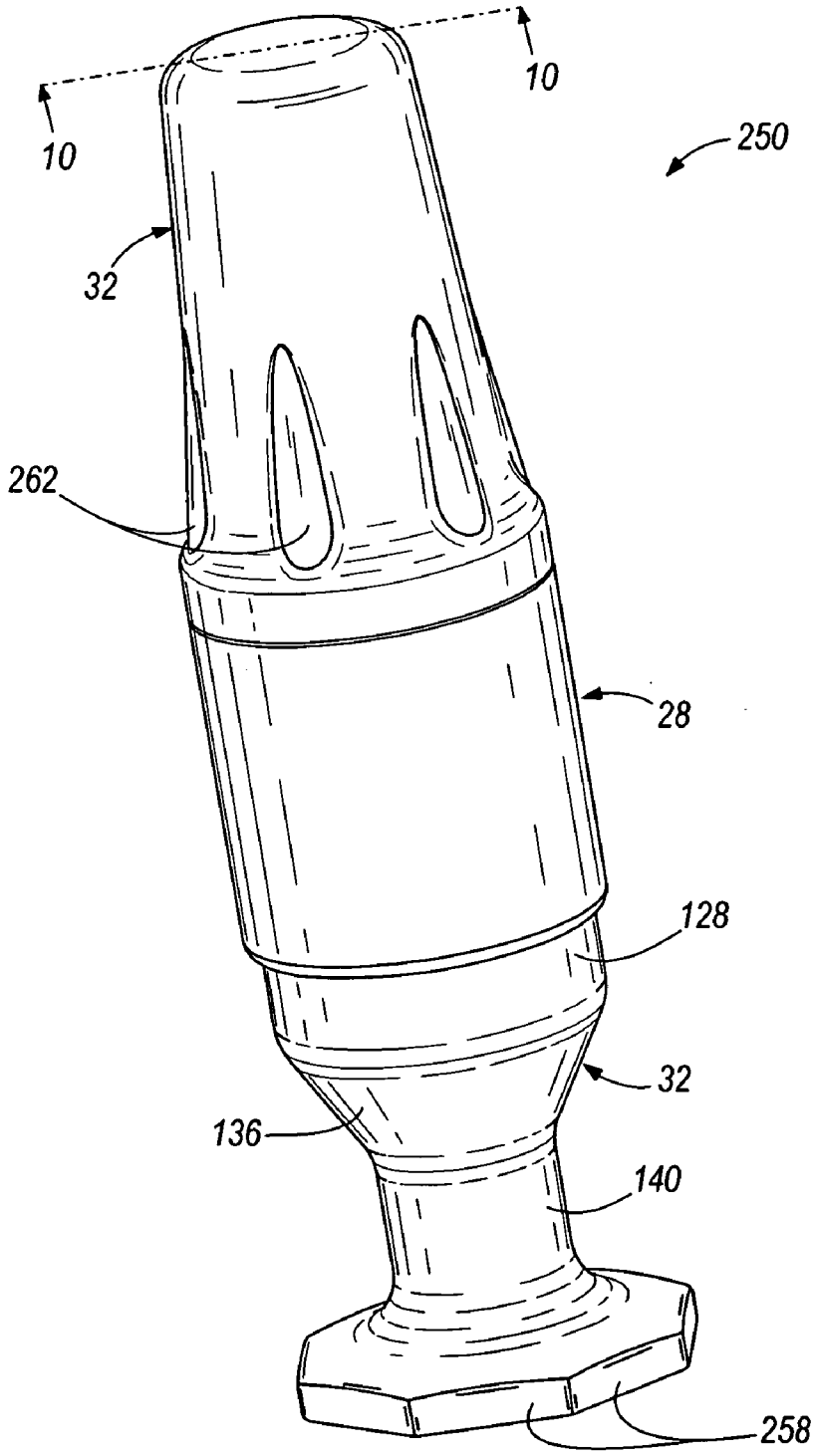
FIG. 8 is a perspective view of a radiation-shielding syringe container embodying some aspects of the present invention.

After the outer sleeve 172 of the syringe sleeve 40 reaches the retracted position, the internally and externally threaded portions 108, 188 are engaged and the syringe sleeve 40 is rotated to axially move the syringe sleeve 40 into the chamber portion 60. The syringe sleeve 40 is rotated until the reduced diameter portion 232 of the syringe 24 is received by the bio-liner 104 within the reduced diameter portion 100 of the chamber portion 60, as shown in FIG. 7. In the illustrated embodiment, the preferred axial position is reached when the bio-liner 104 becomes seated on the reduced diameter portion 232 of the syringe 24. The bio-liner 104 is configured to fit snugly over the reduced diameter portion 232 of the syringe 24, for example by a pressure fit, and will remain in place when the voided syringe 24 is removed from the container 20. The cap 36 is again secured to the body 28 and the container 20 is then ready for transport back to the pharmacy or lab, and is configured substantially as illustrated in FIG. 7.

Upon being returned to a pharmacy or lab, the cap 36 is removed from the body 28, and the syringe 24 is disengaged from the syringe sleeve 40 and removed from the container 20. The configuration of the bio-liner 104 and reduced diameter portion 232 of the syringe 24 is such that the bio-liner 104 remains attached to the syringe 24 as the syringe 24 is removed from the container 20. Once the syringe 24 is removed from the container 20, the needle 224 is still protected by the attached bio-liner 104. The syringe 24 and the bio-liner 104 are disposed of into an appropriate biohazard receptacle. The container 20 is subsequently made ready for reuse by repositioning the syringe sleeve 40 and inserting a new bio-liner 104 into the reduced diameter portion 100 of the chamber portion 60.

In a further embodiment, the radiation-shielding container 20 does not include the bio-liner 104 and the protective cap 240 is reused with the syringe 24 after radiopharmaceutical is dispensed from the syringe 24. In yet another embodiment, the syringe 24 does not include a protective cap 240 and the outer sleeve 172 of the syringe sleeve 40 and the bio-liner 104 are used to protect the needle 224.

FIGS. 8-14 illustrate another embodiment of a radiation-shielding container 250 embodying the invention. The container 250 is similar to the container 20 described above with respect to FIGS. 1-7, therefore, like components are identified by like reference numerals. The radiation-shielding container 250, or radiopharmaceutical pig includes the body 28, the base 32 coupled to the body 28, the cap 36 that is removeably coupled to the body 28, and a syringe sleeve 254 (FIG. 9) that is securable within the body 28. In the illustrated construction, the base 28 includes a plurality of flats 258 and the cap 36 includes a series of raised ridges 262, whereby the flats 258 and ridges 262 facilitate opening and closing of the container 20.

With the radiation-shielding container 250 shown in FIGS. 8-14, the cap-securing structure and the body-securing structure are reversed such that the cap 36 is inserted into the open end 64 of the body 28 to secure the cap 36 to the body 28. The inner surface 56 of the body 28, adjacent the open end 64, defines the cap-securing structure in the form of radially inwardly extending projections 266. In the illustrated embodiment, four projections 266 are provided and are substantially spaced about the circumference of the open end 64. Axially inwardly spaced from the projections 266, the inner surface 56 defines a circumferential groove 270 that is adapted to receive a resilient O-ring 274. The O-ring 274 engages the cap 36 to substantially seal the chamber 44 when the cap 36 is secured to the body 28.

The inner portion 156 of the cap 36 defines an annular protrusion 278 that extends into the open end 64 of the body 28, and the annular protrusion 278 defines a plurality of radially outwardly and circumferentially extending ribs 282. The ribs 282 cooperate with the projections 278 to provide a releasable attachment between the cap 36 and the body 28. In the illustrated embodiment, to couple the cap 36 to the body 28, the annular protrusion 278 is inserted into the open end 64 of the body 28, i.e., the chamber portion 60, and the cap 36, or the body 28, is rotated approximately one-quarter turn to engage the ribs 282 with the projections 266. The annular protrusion 278 also engages the O-ring 274 when the cap 36 is coupled to the body 28 to provide a fluid-tight seal for the chamber 44.

Figure 9:
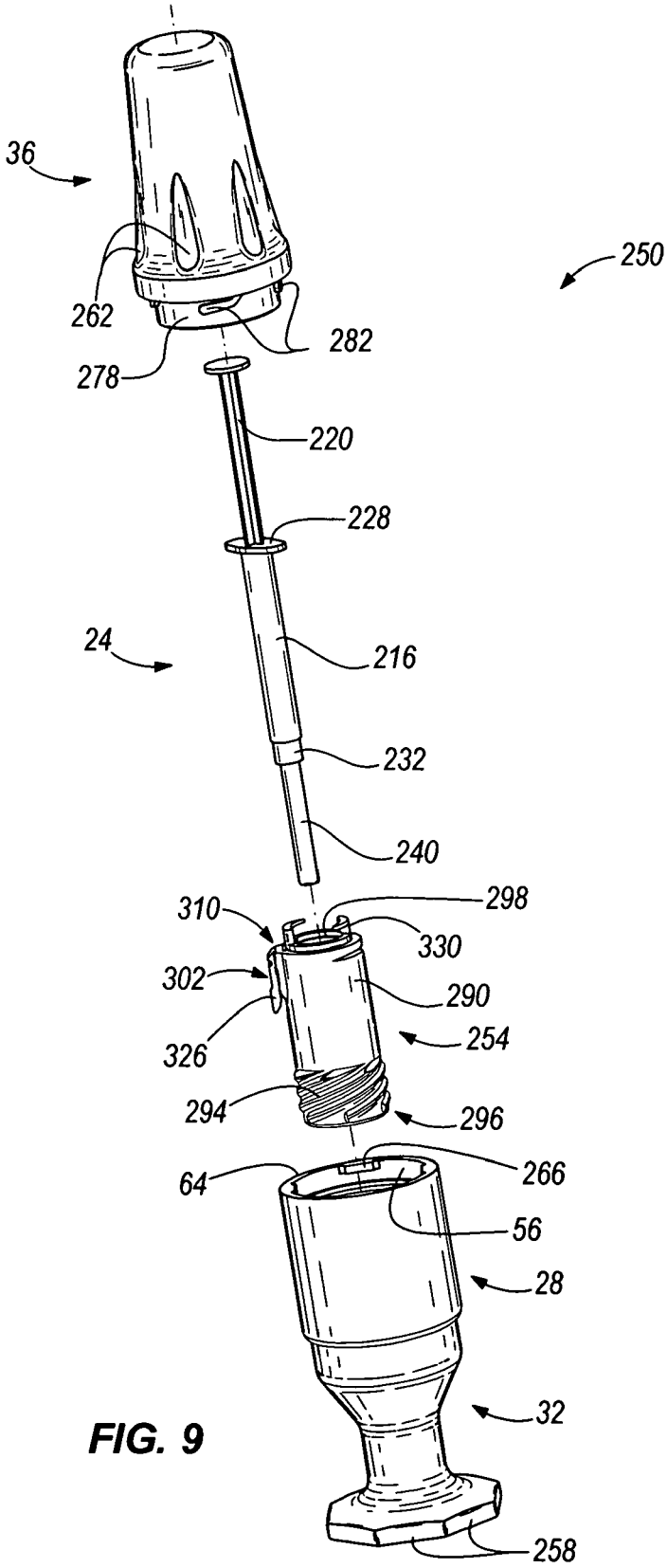
FIG. 9 is an exploded perspective view of the radiation-shielding syringe container illustrated in FIG. 8.
Figure 10:
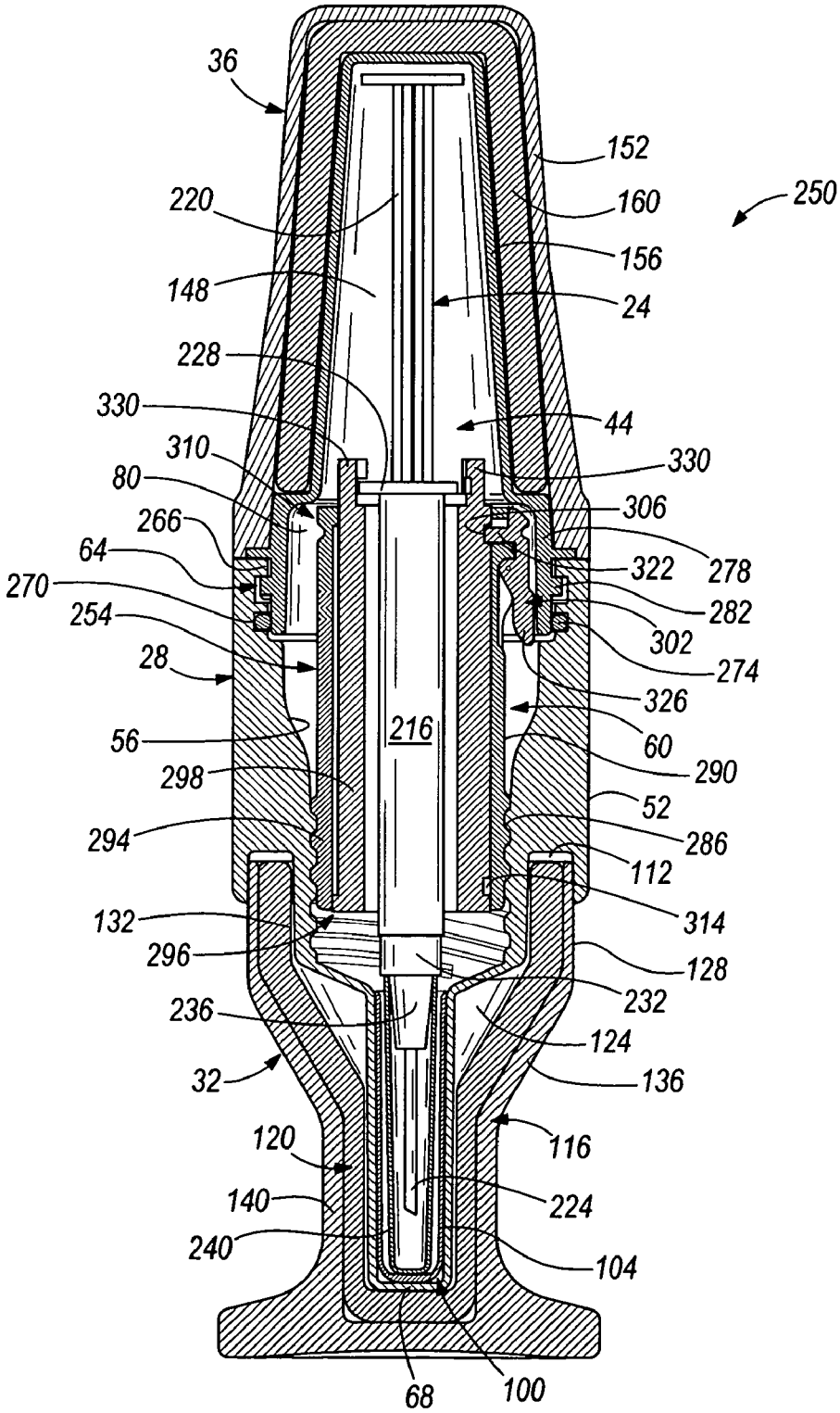
FIG. 10 is a section view taken along line 10-10 of FIG. 8 and showing the container and syringe in a transportation configuration.
Figure 14:
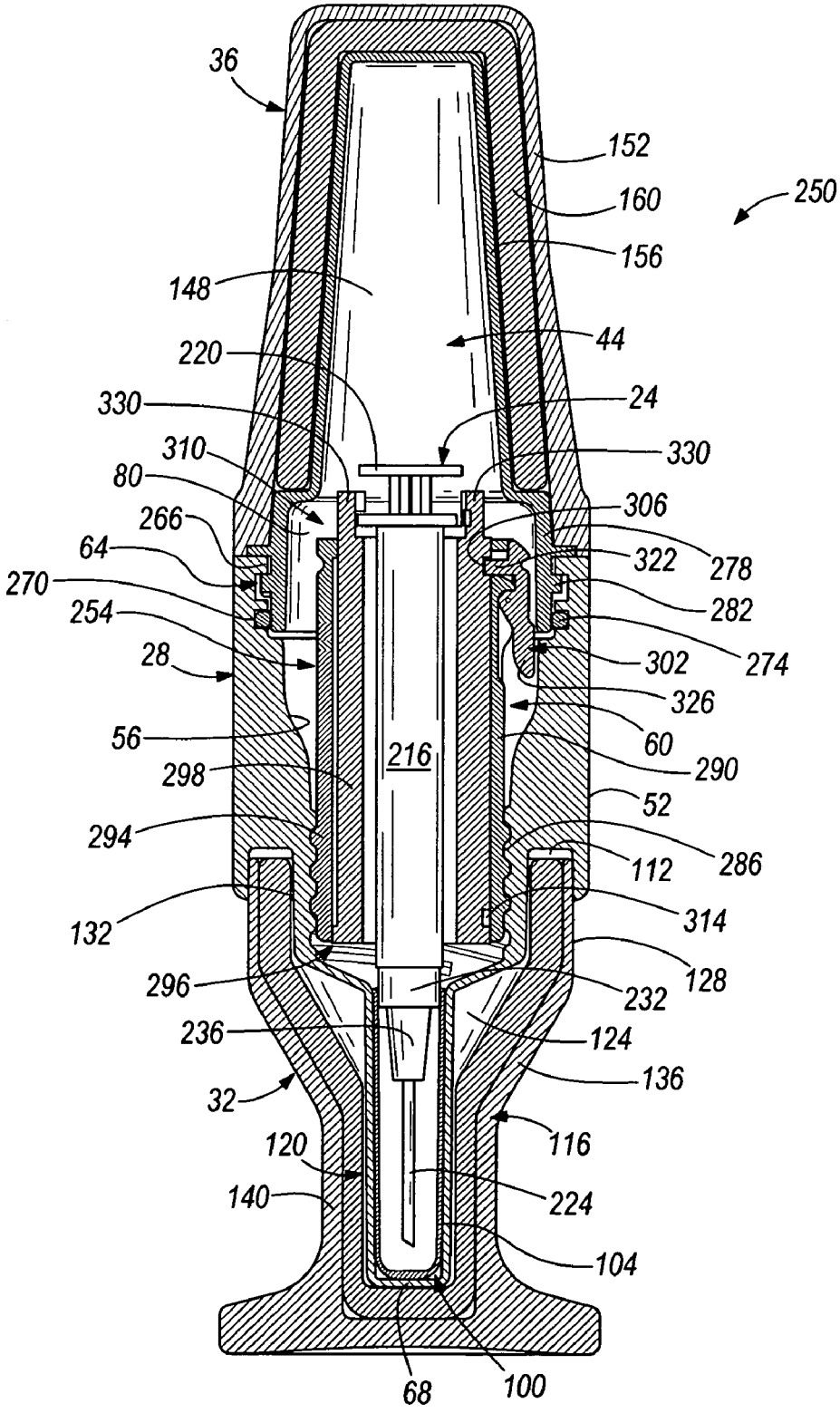
FIG. 14 is a section view similar to FIG. 10 showing the container and syringe configuration after the contents of the syringe have been dispensed and the syringe has been returned to the container.

Referring to FIGS. 9, 10 and 14, the inner surface 56 of the body 28 defines an internally threaded portion 286 for securing the syringe sleeve 254 within the chamber portion 60. An outer sleeve 290 of the syringe sleeve 254 includes an externally threaded portion 294 at a lower end 296 thereof. The externally threaded portion 294 is configured for engagement with the internally threaded portion 286 of the body 28. The threaded arrangement allows for support of the syringe sleeve 254 within the body 28, while also allowing the relative axial positioning of the syringe sleeve 254 with respect to the body 28.

Figure 12:
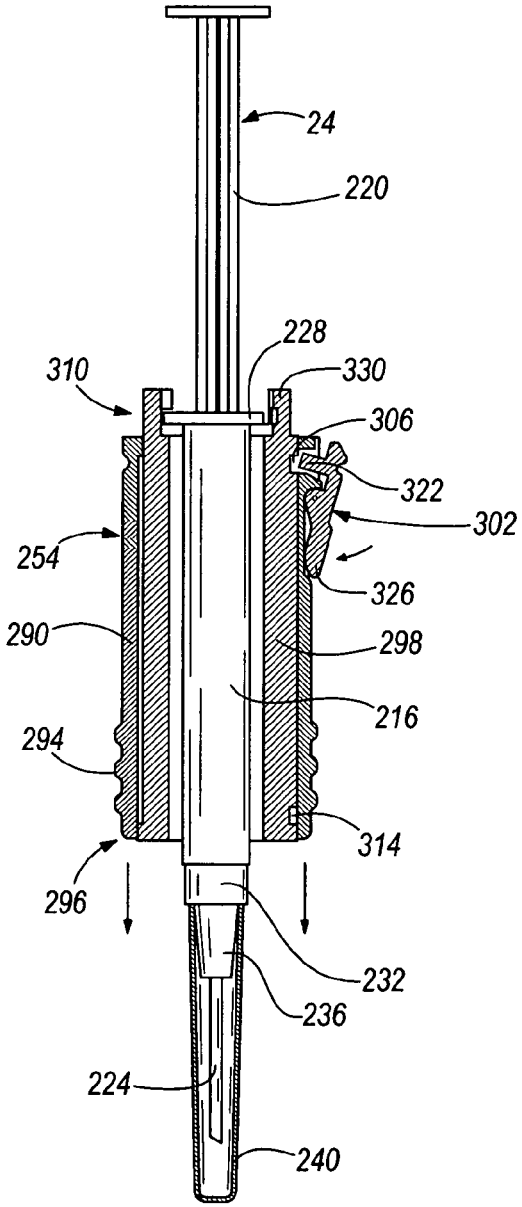
FIG. 12 is a section view of the syringe and a syringe sleeve prior to dispensing a dose.
Figure 13:
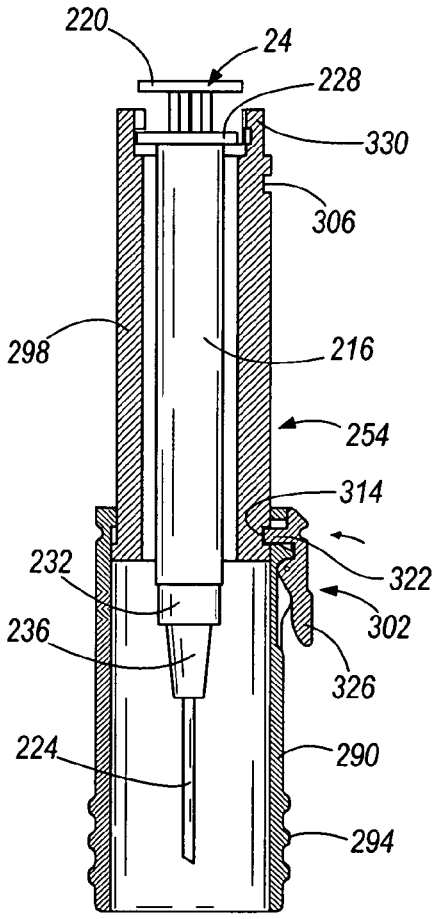
FIG. 13 is a section view similar to FIG. 12 showing an anti-stick barrier of the syringe sleeve in an extended position.

The syringe sleeve 254 is generally cylindrical and includes an inner radiation shield 298, the outer sleeve 290, and a latching member 302 pivotally coupled to the outer sleeve 290. The outer sleeve 290 is axially slidable relative to the radiation shield 298 of the syringe sleeve 254. Referring to FIGS. 12-14, the outer sleeve 290 of the syringe sleeve 254 is axially movable with respect to the radiation shield 298 between a retracted position (FIG. 12) and an extended position (FIG. 13). The radiation shield 298 includes a first recess 306 near an upper end 310 and a second recess 314 near the lower end 296. The latching member 302 includes a tab portion 322 and a downwardly extending actuating portion 326. Similar to the embodiment described above, when the outer sleeve 290 is in the retracted position, the tab portion 322 of the latching member 302 engages and is received by the first recess 306, thereby securing the outer sleeve 290 in the retracted position. To move the outer sleeve 290 to the extended position, the actuating portion 326 is depressed, thereby pivoting the latching member 302 to disengage the tab portion 322 from the first recess 306. The sleeve 290 is then moved axially until the tab portion 322 engages and is received by the second recess 314. The latching member 302 is biased such that the tab portion 322 is urged into positive engagement with the recesses 306, 314.

The syringe sleeve 254 operates similarly to the syringe sleeve 40 described above with respect to FIGS. 1-7, however, the actuating portion 326 of the latching member 302 may be automatically actuated upon insertion of the syringe sleeve 254 into the chamber portion 60 of the body 28. After radiopharmaceutical has been injected into the patient, the outer sleeve 290 of the syringe sleeve 254 is moved to the extended position by operating the latching member 302 in the manner discussed above with respect to FIGS. 12 and 13. When the outer sleeve 290 is in the extended position, it extends beyond the needle 224, thereby creating an anti-stick barrier. The syringe 24 and the syringe sleeve 254 are then returned to the container 250. When the syringe sleeve 254 is inserted into the chamber portion 60, the actuating portion 326 of the latching member 302 is depressed by the inner surface 56 of the body 28 and the tab portion 322 is disengaged from the second recess 314. The outer sleeve 290 is thereby allowed to move toward the retracted position as the radiation shield 298 passes through the open end 64 of the body 28. In another embodiment, the latching member 302 may be manually depressed to allow the outer sleeve 290 to move toward the retracted position.

When the outer sleeve 290 reaches the retracted position, the internally and externally threaded portions 286, 294 are engaged and the syringe sleeve 254 is rotated to move the syringe sleeve 254 axially within the chamber portion 60. The syringe sleeve 254 is rotated until the reduced diameter portion 232 of the syringe 24 is received by the bio-liner 104 as shown in FIG. 14. The bio-liner 104 is configured to fit snugly, e.g., by a pressure fit, over the reduced diameter portion 232 and will remain in place when the voided syringe 24 is removed from the container 20.

Figure 11:
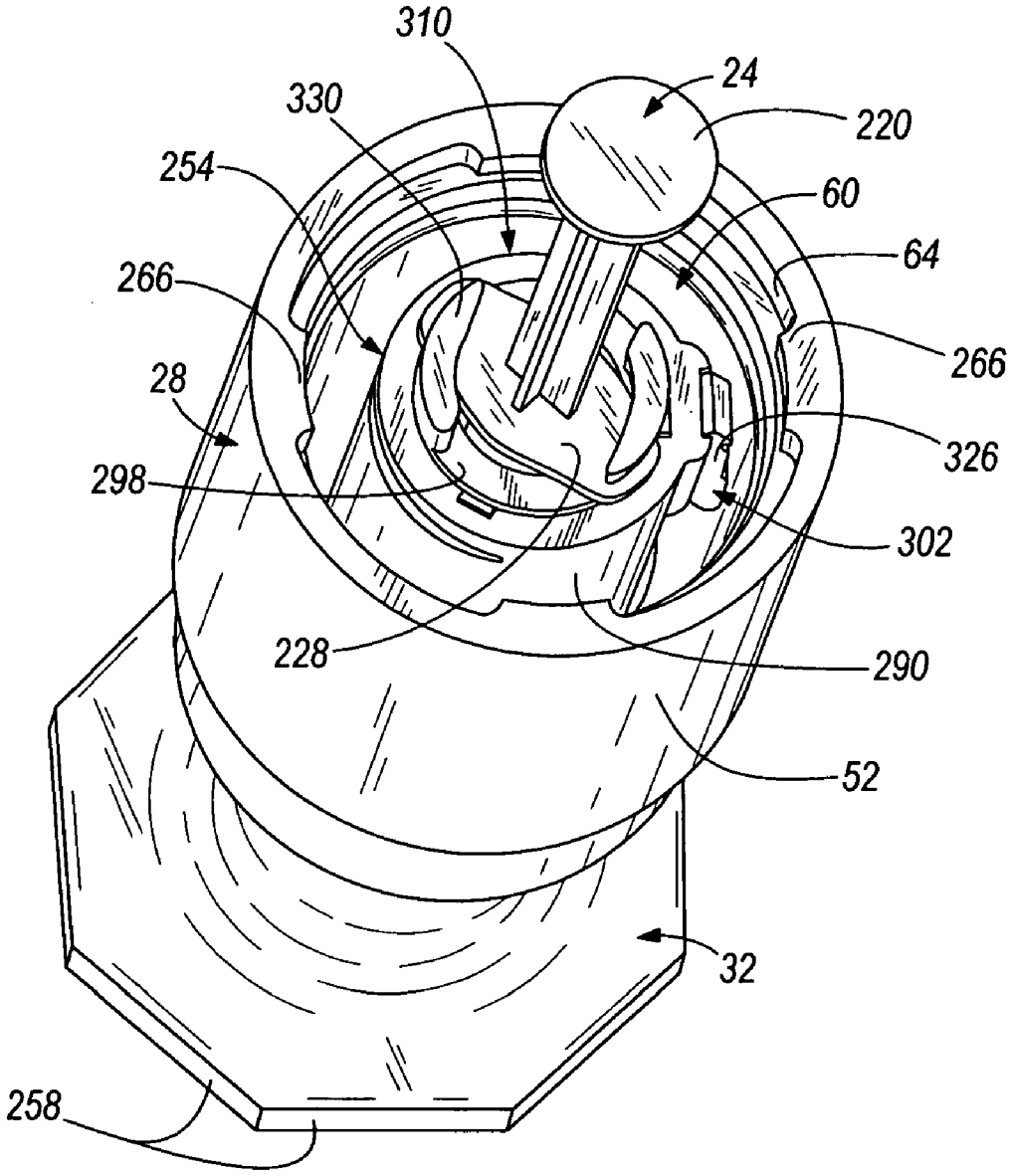
FIG. 11 is a perspective view of the radiation-shielding syringe container illustrated in FIG. 1 with a cap portion removed.

As illustrated by FIG. 11, the syringe sleeve 254 includes a pair of generally L-shaped retaining members 330 at the upper end 310. The L-shaped retaining members 330 are configured to receive and positively capture the flange 228 of the syringe body 216 upon engagement and relative rotating of the body 216 with respect to the syringe sleeve 254. It should be readily apparent to those of skill in the art that in further embodiments of the syringe sleeves 40, 254 retaining members having other shapes, fewer or more retaining members, or other retaining methods may be used.

Various features and advantages of the invention are set forth in the following claims.

What is claimed is:

1. A radiation-shielding container for storing a syringe, the radiation-shielding container comprising:

a base assembly for housing a portion of the syringe, the base assembly including a body portion defining a chamber portion for receiving the syringe and including a base portion coupled to the body portion, the base portion including a radiation shield and a shell positioned proximate an outer surface of the radiation shield;

a sleeve configured for receiving a portion of the syringe, the sleeve housed within the chamber portion and releasably securable to the base assembly; and a cap assembly for housing a portion of the syringe, the cap assembly defining a second chamber portion for receiving the syringe and including a radiation shield and a shell positioned proximate an outer surface of the radiation shield, wherein the cap assembly is securable to the base assembly.

2. The radiation-shielding container of claim 1 wherein the chamber portion of the body portion includes a first portion for receiving the sleeve and a second portion.

3. The radiation-shielding container of claim 2 wherein the second portion includes a reduced diameter relative to the first portion.

4. The radiation-shielding container of claim 2 wherein the body portion includes a first section defining the first portion and a second section defining the second portion, the second section received within the cavity of the base portion of the base assembly.

5. The radiation-shielding container of claim 4 wherein the base portion is coupled to the first section of the body portion.

6. The radiation-shielding container of claim 2, and further comprising a removable liner disposed in the second portion of the body portion, the removable liner attachable to a portion of the syringe.

7. The radiation-shielding container of claim 1, and further comprising:

a cap-securing structure including at least one radially outwardly and circumferentially extending rib defined by the body portion; and a base-securing structure including at least one radially inwardly extending projection defined by the cap assembly for engagement with the cap-securing structure.

8. The radiation-shielding container of claim 1, and further comprising:

a plurality of radially inwardly extending threads defined by the body portion; and a plurality of radially outwardly extending threads defined by the sleeve for engagement with the threads of the body portion.

9. The radiation-shielding container of claim 1 wherein the sleeve includes a generally cylindrical radiation shield defining a channel for receiving the syringe, and an outer sleeve positioned adjacent an outer surface of the radiation shield for securing the sleeve to the base assembly.

10. The radiation-shielding container of claim 9 wherein the outer sleeve is axially movable relative to the radiation shield of the sleeve between a first position and a second position, in which the outer sleeve substantially surrounds a portion of the syringe.

11. The radiation-shielding container of claim 10 wherein the sleeve includes a latching member for retaining the outer sleeve in the first position and the second position, the latching member actuatable to release the outer sleeve from the first position and the second position.

12. The radiation-shielding container of claim 1 wherein the cap assembly includes an inner layer positioned proximate an inner surface of the radiation shield.

13. The radiation-shielding container of claim 12 wherein the inner layer of the cap assembly defines a base-securing structure for securing the cap assembly to the base assembly.

14. A radiation-shielding container comprising:

a syringe including a body, a plunger depending from one end of the body and axially movable relative to the body, and a needle extending from an opposite end of the body;

a base assembly for housing a portion of the syringe, the base assembly including a body portion defining a chamber portion for receiving at least the body and the needle of syringe and including a base portion coupled to the body portion and defining a cavity for receiving a portion of the body portion, the base portion including a radiation shield and a shell positioned proximate an outer surface of the radiation shield;

a sleeve configured for receiving at least the body of the syringe, the sleeve housed within the chamber portion and securable to the base assembly; and a cap assembly for housing a portion of the syringe, the cap assembly defining a second chamber portion for receiving at least the plunger of the syringe and including a radiation shield and a shell positioned proximate an outer surface of the radiation shield, wherein the cap assembly is securable to the base assembly.

15. The radiation-shielding container of claim 14 wherein the body portion includes a first section defining a first portion of the chamber portion and a second section defining a second portion of the chamber portion, the second section received within the cavity of the base portion of the base assembly.

16. The radiation-shielding container of claim 15, and further comprising a removable liner disposed in the second portion, the removable liner attachable to a portion of the syringe adjacent the needle.

17. The radiation-shielding container of claim 15 wherein the second portion includes a reduced diameter relative to the first portion.

18. The radiation-shielding container of claim 14 wherein the sleeve includes a retaining member for holding the syringe within the sleeve.

19. The radiation-shielding container of claim 14 wherein the sleeve includes a generally cylindrical radiation shield defining a channel for receiving the syringe, and an outer sleeve positioned adjacent an outer surface of the radiation shield for securing the sleeve to the base assembly.

20. The radiation-shielding container of claim 19 wherein the outer sleeve is axially movable relative to the radiation shield of the sleeve between a first position and a second position, in which the outer sleeve substantially surrounds the needle of the syringe.

21. The radiation-shielding container of claim 20 wherein the sleeve includes a latching member for retaining the outer sleeve in the first position and the second position, the latching member actuatable to release the outer sleeve from the first position and the second position.

22. A radiation-shielding container for storing a syringe, the radiation-shielding container comprising:

a base assembly defining a cavity, the base assembly including a radiation shield and a shell positioned proximate an outer surface of the radiation shield;

a body assembly including a first section defining a first chamber portion and a second section defining a second chamber portion for receiving a portion of the syringe, wherein the first section is coupled to the base assembly and the second section is received within the cavity;

a sleeve being generally cylindrical and adapted and configured for receiving a portion of the syringe, the sleeve housed within the first chamber portion of the body assembly and releasably securable to the first section, the sleeve including a radiation shield; and a cap assembly defining a chamber portion for receiving a portion of the syringe and including a radiation shield and a shell positioned proximate an outside surface of the radiation shield, wherein the cap assembly is securable to the body assembly.

23. The radiation-shielding container of claim 22 wherein the second chamber portion has a reduced diameter relative to the first chamber portion.

24. The radiation-shielding container of claim 22 wherein the sleeve includes an outer sleeve positioned adjacent an outer surface of the radiation shield for securing the sleeve to the base assembly, the outer sleeve axially movable relative to the radiation shield between a first position and a second position, in which the outer sleeve substantially surrounds a portion of the syringe.

25. The radiation-shielding container of claim 24 wherein the sleeve includes a latching member for retaining the outer sleeve in the first position and the second position, the latching member actuatable to release the outer sleeve from the first position to the second position.

26. The radiation-shielding container of claim 22, and further comprising a removable liner disposed in the second chamber portion of the body assembly, the removable liner attachable to a portion of the syringe.

27. The radiation-shielding container of claim 22, and further comprising:

a cap-securing structure including at least one radially outwardly and circumferentially extending rib defined by the body assembly; and a base-securing structure including at least one radially inwardly extending projection defined by the cap assembly for engagement with the cap-securing structure of the body assembly.

28. The radiation-shielding container of claim 22, and further comprising:

a plurality of radially inwardly extending threads defined by the body assembly; and a plurality of radially outwardly extending threads defined by the sleeve for engagement with the threads of the body assembly.

* * * * *